United States Patent [19]

Kallman

[11] 3,950,927

[45] Apr. 20, 1976

[54] APPARATUS AND METHOD FOR MEASURING YARN STORAGE AT A SPINDLE ASSEMBLY STATION IN A TEXTILE YARN PROCESSING MACHINE

[75] Inventor: Jurgen Kallman, Willich, Germany

[73] Assignee: Palitex Project-Company G.m.b.H., Germany

[22] Filed: Apr. 4, 1975

[21] Appl. No.: 565,060

[30] Foreign Application Priority Data

Apr. 13, 1974 Germany ..... 2418246

[52] U.S. Cl. ..... 57/34 R; 57/58.83; 57/58.84; 57/156

[51] Int. Cl.[2] ..... D01H 1/10; D01H 13/32

[58] Field of Search ..... 57/34 R, 58.3, 58.49, 57/58.7, 58.83, 58.84, 58.86, 93, 94, 156

[56] References Cited

UNITED STATES PATENTS

| | | | |
|---|---|---|---|
| 2,869,313 | 1/1959 | Vibber | 57/58.3 |
| 2,869,315 | 1/1959 | Klein | 57/58.84 |
| 2,939,267 | 6/1960 | Klein | 57/58.3 |
| 3,445,998 | 5/1969 | Nakahara et al. | 57/58.84 |

*Primary Examiner*—John Petrakes
*Attorney, Agent, or Firm*—Bell, Seltzer, Park & Gibson

[57] ABSTRACT

An apparatus and method for measuring yarn storage at a spindle assembly station in a textile yarn processing machine, such as a two-for-one twister or the like, in which each station includes a spindle assembly for carrying a package of yarn to be withdrawn and processed while producing a rotating balloon of the yarn around the package and having a driven rotor mechanism including a yarn reserve disc providing a passageway for the yarn therethrough from the package and for storing a length of the yarn therearound prior to formation of the balloon of yarn, as follows. First and second electrical pulse generating devices generate electrical pulses in response to the frequency of rotation of the rotor mechanism and the balloon of yarn, respectively. A mechanism is connected with the pulse generating devices for counting the generated pulses and for evaluating the time $t_B$ required for the first pulse generator to generate a predetermined number of pulses and the time $t_S$ required for the second pulse generator to generate a predetermined number of pulses and for calculating and displaying the time difference $\Delta t = t_B - t_S$ as a measure of yarn storage on the reserve disc.

10 Claims, 5 Drawing Figures

APPARATUS AND METHOD FOR MEASURING YARN STORAGE AT A SPINDLE ASSEMBLY STATION IN A TEXTILE YARN PROCESSING MACHINE

This invention relates to a method and apparatus for measuring yarn storage around a yarn reserve disc at a spindle assembly station in a textile yarn processing machine, particularly a two-for-one twister.

BACKGROUND OF THE INVENTION

An absolutely necessary and important observational criterion for the correct processing of yarn in a yarn processing machine, such as a two-for-one twister having spindle assembly stations in which each include a spindle assembly for carrying a package of yarn to be withdrawn and processed while producing a rotating balloon of the yarn around the package and having a hollow carrier mechanism for supporting the package of yarn to be processed and providing a passageway for receiving the yarn as it is withdrawn from the package and a driven rotor mechanism supporting the carrier mechanism and rotating relative thereto and including a yarn reserve disc providing a passageway for the yarn therethrough from the carrier mechanism and for storing a length of yarn therearound prior to the formation of the balloon of yarn, is observation of the amount of yarn storage on the reserve disc.

This yarn storage is, as is well known, the equalizing factor between internal drawing off tension of the yarn from the supply package and the yarn balloon forces. Excess or too little yarn storage gives rise to adverse consequential phenomina which results in yarn breakage. Yarn storage must be individually adjusted taking into account yarn quality, the rotational speed of the rotor mechanism of the spindle assembly and also, in part, the drawing-off velocity which is determined by the conventional take-up mechanism in the spindle assembly.

The determination of the yarn storage, i.e. essentially the determination of the angle of wrap of the yarn around the reserve disc, is at present carried out by observation through a stroboscope, and, depending upon the angle of wrap or the amount of yarn around the reserve disc, the rotational speed of the rotor mechanism of the spindle assembly is varied, or alternatively the interior drawing-off tension of the yarn is equalized by means of a yarn break within the spindle assembly.

In certain cases, particularly spindle assemblies which are encapsulated by double walls for noise, moisture, temperature, etc. conditions, it is no longer possible to exercise a purely visual inspection of the storage of yarn around the reserve disc unless the spindle assembly is provided with access apertures in the encapsulating walls, which would partially nullify the desired effect of the encapsulation.

OBJECTS AND SUMMARY OF THE INVENTION

Accordingly, it is the object of this invention to provide an apparatus and method for measuring the yarn storage on a reserve disc of a rotor mechanism of a spindle assembly of a textile yarn processing machine, such as a two-for-one twister, and which overcomes the above problems with the prior operation.

It has been found by this invention that the above objects may be accomplished by providing a method comprising the steps of: counting a predetermined number of revolutions of the rotor mechanism of the spindle assembly; counting a predetermined number of revolutions of the rotating balloon of yarn; and evaluating the time $t_B$ required for the predetermined number of revolutions of the rotor mechanism and the time $t_S$ required for the predetermined number of revolutions of the balloon of yarn and calculating the time difference $\Delta t = t_B - t_S$ as a measure of yarn storage on the reserve disc.

In accordance with this invention the above object is also accomplished by providing means for measuring the yarn storage of the reserve disc of the rotor mechanism comprising the following. A first electrical pulse generating means is responsive to the frequency of rotation of the rotor mechanism for generating electrical pulses. A second electrical pulse generating means is responsive to the frequency of rotation of the balloon of yarn for generating electrical pulses. Means are connected with the pulse generating means for counting the pulses generated by each of the pulse generating means and for evaluating the time $t_B$ required for the first generating means to generate a predetermined number of pulses and the time $t_S$ required for the second pulse generating means to generate a predetermined number of pulses and for calculating and displaying the time difference $\Delta t = t_B - t_S$ as a measure of yarn storage on the reserve disc.

Further specifics of the method and apparatus of this invention will become apparent from the detailed description to follow.

BRIEF DESCRIPTION OF THE DRAWINGS

Some of the objects and advantages of this invention having been set forth, other objects and advantages will appear, when taken in conjunction with the accompanying drawings, in which.

DESCRIPTION OF PREFERRED EMBODIMENT

While the drawings and specific description to follow will be related to a two-for-one twister yarn processing machine, which is the preferred form of machine utilizing the improved apparatus and method of this invention, it is to be understood that the improved apparatus and method of this invention could be utilized with other types of yarn processing machines for which a measurement of yarn storage on a reserve disc of a spindle assembly is desired.

Figure 1:
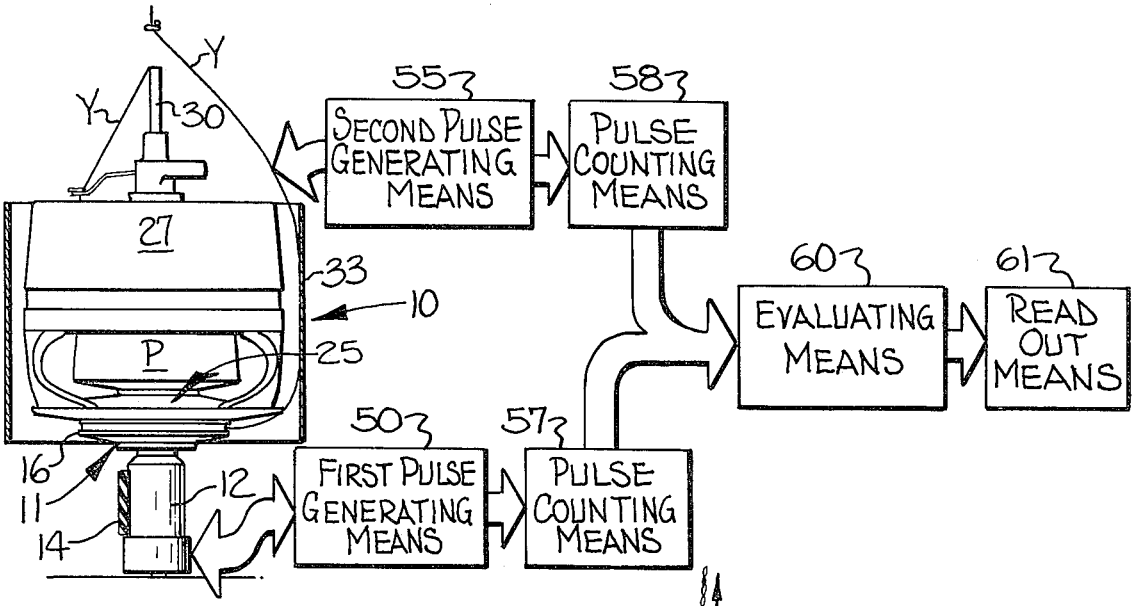
FIG. 1 is a schematic view illustrating a spindle assembly of a two-for-one twister yarn processing machine utilizing the improved apparatus and method of this invention.

Referring now to the drawings, there is illustrated in FIG. 1, a schematic view of a portion of a single spindle assembly 10 at one spindle assembly station of a two-for-one twister yarn processing machine. It is to be understood that a plurality of these spindle assembly stations are provided in generally side-by-side relationship in two rows along the outside of the yarn processing machine. A full illustration and description of the entire two-for-one twister yarn processing machine is not given herein and is not believed to be necessary for an understanding of the present invention, the operation and structure of such two-for-one twister yarn processing machines being well understood by those with ordinary skill in the art.

Generally, each of the spindle assemblies 10 comprise a rotatably driven rotor mechanism 11 which includes a whorl 12 suitably rotatably mounted on the twister machine frame (not shown) and rotated by a continuous drive belt 14. The rotor mechanism 11 further includes a generally horizontally extending reserve disc 16 secured to the whorl 12 for being rotated therewith and a generally vertically extending, hollow axle device 17 (see FIG. 3) extending upwardly from the reserve disc 16. The reserve disc 16 and the hollow axle device 17 define a generally vertically extending yarn passageway 20 extending through the hollow axle device and partly through the reserve disc 16 and mating horizontally extending yarn passageways 21 extending through and out of the reserve disc 16.

The spindle assembly 10 further includes a carrier mechanism 25 for carrying a hollow package P of yarn Y and being rotatably mounted on the rotor mechanism 11 by bearings 26 (see FIG. 3) so that the rotor mechanism 11 may rotate relative to the carrier mechanism 25 which is maintained generally stationary. The carrier mechanism 25 includes a basket device 27 which surrounds the package P of yarn Y and a hollow yarn package carrier member 28 onto which the hollow package P of yarn Y is supported. The hollow carrier member 28 may also include a hollow yarn entry tube 30 carried within the carrier member 28 and extending outwardly therefrom axially of the supply package P supported thereon for receiving the yarn Y from the supply package P and providing an axially extending passageway 31 for receiving and allowing passage of the yarn Y therethrough and mating with the hollow interior of the carrier member 28 which provides a passageway 32 for the yarn and which mates with the passageways 20, 21 of the hollow axle 17 and the reserve disc 16.

The spindle assembly 10 further includes a balloon limitor device 33 surrounding the basket device 27 so as to contain the balloon of yarn Y formed on the outside of the basket device 26. A yarn guide eyelet 40 is positioned above and in axial alignment with the yarn entry tube 30. There is further provided take-up mechanisms (not shown) including a traversing device and a take-up roll for taking up and forming a package of the twisted or processed yarn processed by the spindle assembly 10. These take-up mechanisms are conventional in two-for-one yarn processing machines and an illustration thereof and further explanation thereof is not believed necessary herein for a full understanding of this invention.

With the above described mechanisms of the spindle assembly 10, the yarn Y passes from the package P through the yarn entry tube 30 and its passageway 31, through the passageway 32 of the carrier member 28, through the vertically extending yarn passageway 20 in the hollow axle device 17, through the horizontally extending passageway 21 in the reserve disc 16 and out of the reserve disc 16 in a horizontal direction. The yarn then passes upwardly between the basket device 27 and the balloon limitor 33 and forms a balloon of yarn which is contained by the balloon limitor device 33. The yarn then passes through yarn guide eyelet 40 and is taken up by the take-up mechanisms. As is well understood by those with ordinary skill in the art, a two-for-one twist is inserted in the yarn during the above-noted path of travel due to rotation of the rotor mechanism 11 causing rotation of the balloon of yarn Y, described above.

Figure 2:
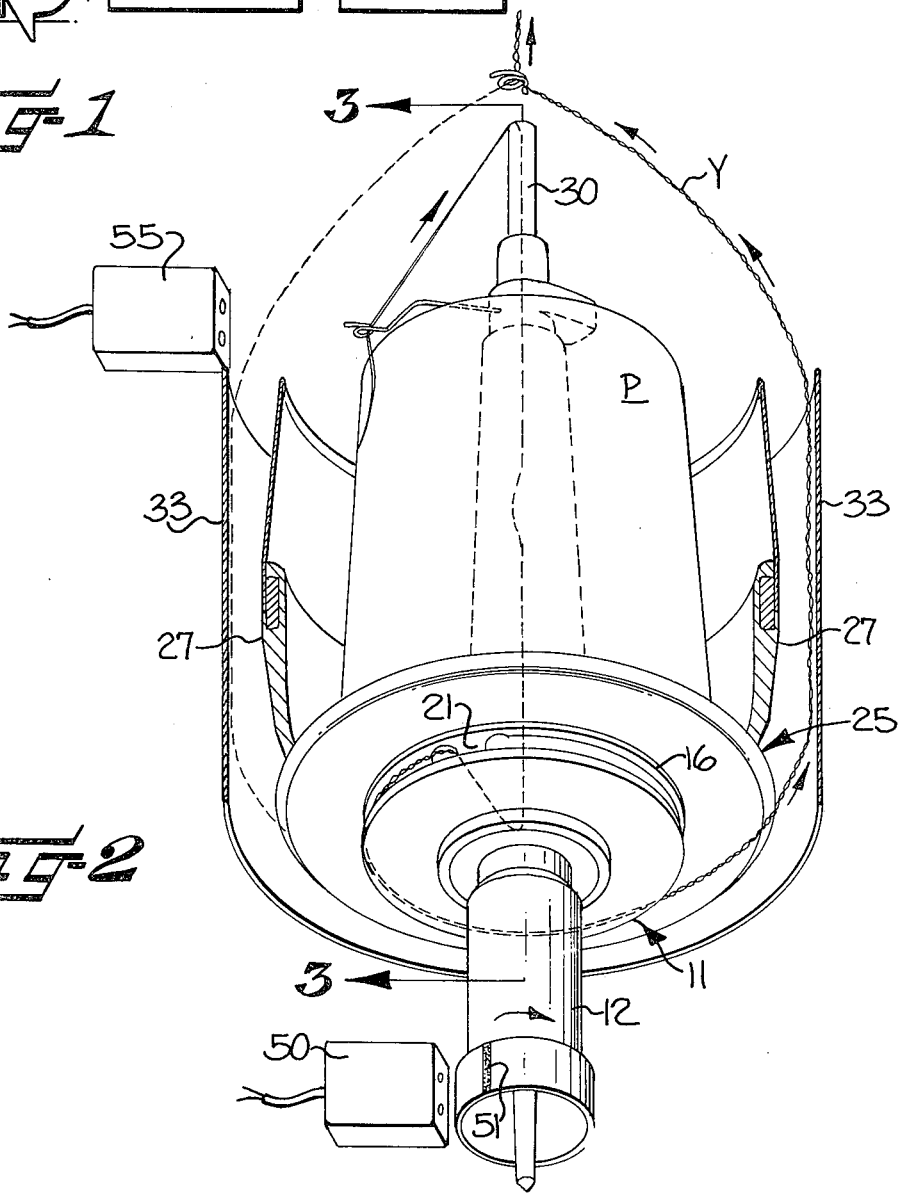
FIG. 2 is an enlarged, perspective view, partially in section, of the spindle assembly of FIG. 1 utilizing the apparatus of this invention and illustrating a desired amount of yarn storage on the reserve disc.
Figure 3:
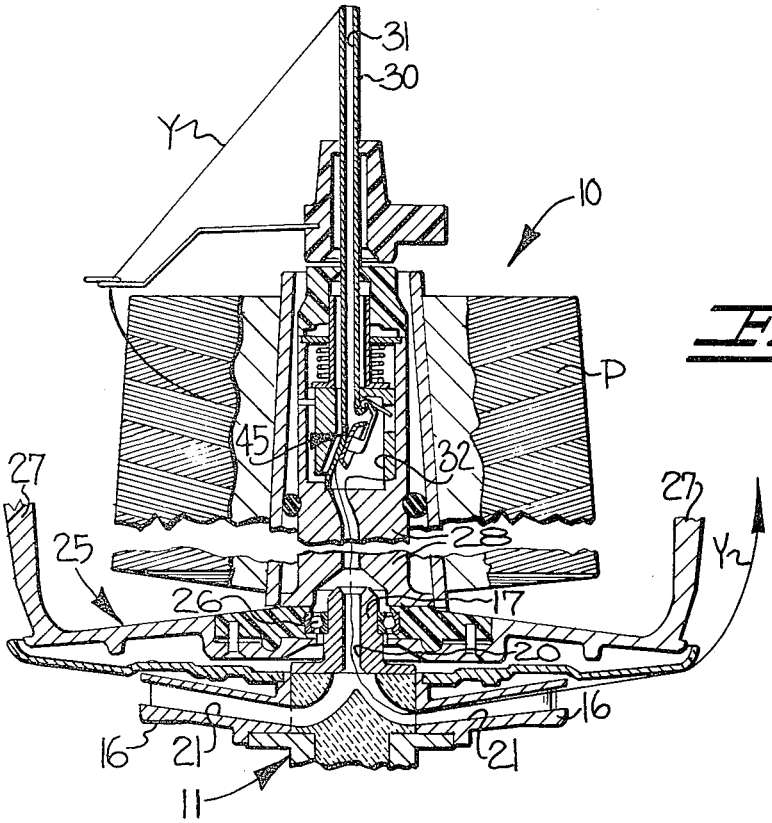
FIG. 3 is a sectional view, taken generally along the line 3—3 of FIG. 2.

During the above-noted path of travel, the yarn emerging from the passageway 21 of the reserve disc 16 is wrapped around the outside circumference of the reserve disc 16, as shown in FIG. 2 due to the lag in rotation of the balloon of yarn with respect to rotation of the rotor mechanism 11 caused by the frictional resistance to rotation of the balloon of yarn and in part by the speed of the rotor mechanism 11 and the take-up mechanisms. It is desired to maintain storage of yarn around the reserve disc 16, but, as discussed above, too much storage of yarn around the reserve disc causes adverse effects in the yarn processing operation. These adverse effects may be controlled by varying the rotational speed of the rotor mechanism 11, or alternatively, the interior drawing off tension of the yarn Y from the package P may be controlled by the use of a suitable yarn brake mechanism, generally indicated at 45, as shown in FIG. 3. This brake mechanism is disposed in the hollow interior or passageway 32 of the yarn carrier member 28 and may be of the type set forth in U.S. Pat. No. 3,490,221, issued Jan. 20, 1970, and assigned to the assignee of the present invention.

Figure 4:
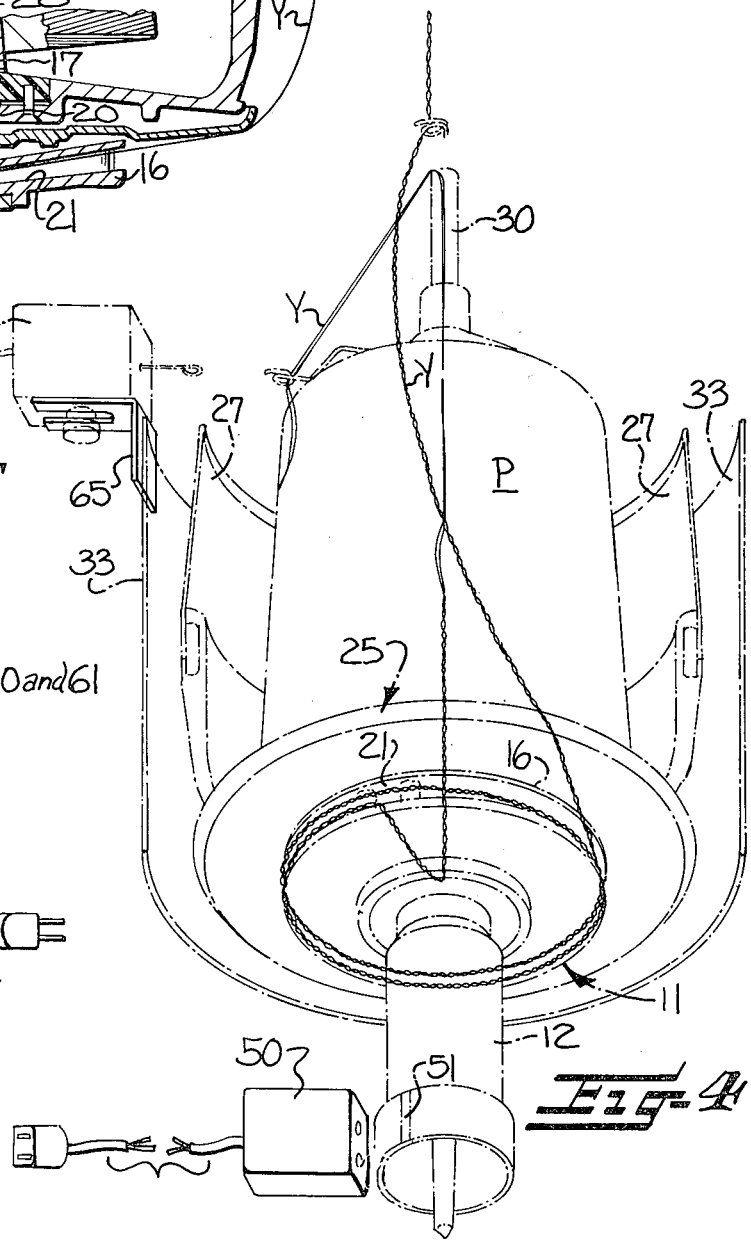
FIG. 4 is a view somewhat like FIG. 3 utilizing an alternative embodiment of a portion of the apparatus of this invention and illustrating an undesired amount of yarn storage on the reserve disc.

As shown in FIG. 2, an angle of wrap around the reserve disc 16 of the yarn Y is approximately 200° which is a desirable angle of wrap or amount of yarn storage on the reserve disc 16. Whereas, as shown in FIG. 4, an angle of wrap or yarn storage on the reserve disc 16 is approximately 630° which is excessive and will cause adverse effects, as discussed above, during the processing or twisting of the yarn Y.

Accordingly, in accordance with this invention, a method and apparatus is provided for measuring the amount of yarn storage around the reserve disc 16 of the spindle assembly 10. The apparatus comprises first electrical pulse generating means 50 responsive to the frequency of rotation of the rotor mechanism 11 for generating electrical pulses. This first electrical pulse generating means 50 preferably is in the form of a photoelectric cell switch mechanism suitably mounted on the twister machine frame adjacent the whorl 12 of the rotor mechanism 11. The whorl 12 may include a strip 51 of material which may be detected by the photoelectric cell switch mechanism upon rotation of the rotor mechanism 11 and the whorl 12 so that upon each rotation of the rotor mechanism 11, the photoelectric cell switch mechanism will be actuated for generating an electrical pulse.

The apparatus further comprises a second electrical pulse generating means 55 which is suitably mounted on the twister machine adjacent the top edge of the balloon restrainer 33 and the basket device 27 for being responsive to the frequency of rotation of the balloon of yarn Y for generating electrical pulses. Preferably, as shown in FIG. 2, this second electrical pulse generating means 55 comprises a photoelectric cell switch mechanism which is actuated upon each rotation of the balloon of yarn Y for generating an electrical pulse in response thereto.

These photoelectric cell switch mechanisms may be any suitable, commmerically available mechanisms and the construction and operation thereof is well understood by those with ordinary skill in the art.

As shown schematically in FIG. 1, pulse counting devices 57, 58 are connected with the first and second electrical pulse generating means 50, 55, respectively, for counting a predetermined number of the electrical pulses generated by each of the respective pulse generating means 50, 55. An evaluating means 60 is operatively and electrically connected with the pulse counting devices 57, 58 for evaluating the time $t_B$ required for the first pulse generating means 50 to generate the predetermined number of pulses and the time $t_S$ required for the second pulse generating means 55 to generate the predetermined number of pulses and for calculating the time difference $\Delta t = t_B - t_S$ and displaying such calculated time difference $\Delta t$ on a suitable readout device 61 as a measure of yarn storage on the reserve disc.

The pulse counting devices 57, 58, evaluating means 60 and readout device 61 are shown schematically only in the drawings and are illustrated therein as separate devices; however, separate or single arithmetic units for performing these counting, evaluating and digital readout displaying functions are commercially available and their operation is well understood by those with ordinary skill in the art. Accordingly, a detailed illustration and explanation of the construction and operation thereof is not deemed necessary herein for an understanding of the method and apparatus of this invention.

It may be desired in the use of the apparatus of this invention to express and provide a readout of the measure of yarn storage on the reserve disc 16 in terms of fractions or proportions of a complete revolution of yarn Y around the reserve disc 16. In this case, the time difference $\Delta t$, determined as explained above, may be multiplied by the frequency of rotation of the rotor mechanism 11 in one second which is equal to the number of pulses generated by the first electrical pulse generating means 50 in 1 second, or the time difference $\Delta t$ may be divided by the time period between two revolutions of the rotor mechanism 11 or the time period between two pulses generated by the first electrical pulse generating means 50. These values may be displayed on the readout means 61 as a measure of yarn storage on the reserve disc in fractions of a complete revolution of the yarn Y around the reserve disc 16, or it may be desired to have these results multiplied by 360 to express the storage of yarn Y on the reserve disc 16 in terms of angular degrees.

Figure 5:
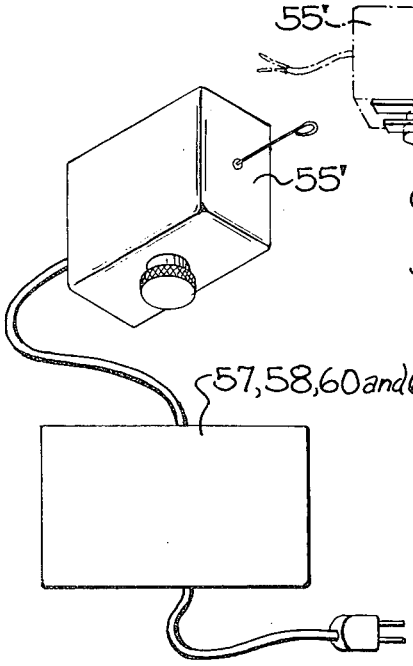
FIG. 5 is a perspective view of a portion of the alternative apparatus of this invention, shown in FIG. 4.

In some cases, such as where it is desired to divide the time difference $\Delta t$ by the time between two pulses generated by the first pulse generating means 50, it is preferable for the second pulse generating means 55 to comprise a non-interacting, yarn feeler switch mechanism 55', as shown in FIGS. 4 and 5.

The pulse counting devices 57, 58, the evaluating device 60 and the readout device 61 may all constitute a single arithmetic unit, as discussed above, and may be permanently affixed at the particular spindle assembly 10, or may be separate from the spindle assembly 10 and portably brought into the vicinity of the particular spindle assembly 10 and electrically connected with the first and second electrical pulse generating devices 50, 55. Also, the first pulse generating device 50 may be permanently affixed to the spindle assembly 10 in the vicinity of the whorl 12 of the rotor mechanism 11 and the second pulse generating means 55', as shown in FIGS. 5 and 6, may be separate from the spindle assembly 10 and portably brought to the spindle assembly 10 and secured to a bracket, such as the bracket 65 shown in FIG. 4, for performing a check at the specific spindle assembly 10. As indicated in FIG. 5, the second pulse generating device 55 and the arithmetic unit may be a connected portable unit brought to specific spindle assemblies 10.

By the above apparatus, the yarn storage on a reserve disc 16 of a spindle assembly 10 in a textile yarn processing machine may be measured by the steps of: counting a predetermined number of revolutions of the rotor mechanism 11 of the spindle assembly 10; counting a predetermined number of revolutions of the rotating balloon of yarn; and evaluating the time $t_B$ required for the predetermined number of revolutions of the rotor mechanism 11 and the time $t_S$ required for the predetermined number of revolutions of the balloon of yarn from start-up of the spindle assembly 10 and calculating the time difference $\Delta t = t_B - t_S$ as a measure of yarn storage on the reserve disc 16.

The method may include the further step of multiplying the time difference $\Delta t$ by the frequency of rotation of the rotor mechanism 11 which is equal to the number of revolutions of the rotor mechanism 11 in one second as a measure of yarn storage on the reserve disc 16 in fractions of a complete revolution of yarn Y around the reserve disc 16. Or, the calculated time difference $\Delta t$ may be divided by the time between two revolutions of the rotor mechanism 11 as a measure of yarn storage on the reserve disc 16 in fractions of a complete revolution of yarn around the reserve disc. The above results may be multiplied by 360 to obtain the angle of wrap of the yarn around the reserve disc 16 in angular degrees.

Preferably, the method also includes the steps of generating electrical pulses in response to the frequency of rotation of the rotor mechanism 11 of the spindle assembly or the generation of one pulse for each rotation of the rotor mechanism, and generating electrical pulses in response to the frequency of rotation of the balloon of yarn or the generation of one pulse for each rotation of the balloon of yarn, and counting the predetermined number of pulses generated for each as a measure of the number of revolutions of each of the rotor mechanism and the balloon of yarn.

In actual practice, the travel pattern of the yarn Y, due to air resistance and also friction between the yarn Y and the balloon limitor 33, causes a spatial curving of the yarn balloon. A value representing this curving of the yarn balloon could be subtracted from the time $\Delta t$ calculated by the method and apparatus of this invention for a technically accurate measurement. However, the measurement calculations obtained by the above described method and apparatus of this invention are not fundamentally affected as far as operation of the yarn processing machine is concerned in spite of the curving of the yarn balloon.

In the drawings and specification, there has been set forth a preferred embodiment of this invention and, although specific terms are employed, they are used in a generic and descriptive sense only and not for purposes of limitation.

What is claimed is:

1. In a textile yarn processing machine, such as a two-for-one twister or the like, having spindle assembly stations for the processing of yarn and each including a spindle assembly for carrying a package of yarn to be withdrawn and processed while producing a rotating balloon of the yarn around the package and having a hollow carrier mechanism for supporting the package of yarn to be processed and providing a passageway for receiving the yarn as it is withdrawn from the package, and a driven rotor mechanism supporting said carrier mechanism and rotating relative thereto and including a yarn reserve disc providing a passageway for the yarn therethrough from the carrier mechanism and for storing a length of yarn therearound prior to the formation of the balloon of yarn; the combination therewith of means for measuring the yarn storage on said reserve disc of said rotor mechanism comprising:

first electrical pulse generating means responsive to the frequency of rotation of said rotor mechanism for generating electrical pulses;

second electrical pulse generating means responsive to the frequency of rotation of the balloon of yarn for generating electrical pulses; and means connected with said pulse generating means for counting the pulses generated by each of said pulse generating means, for evaluating the time $t_B$ required for said first pulse generating means to generate a predetermined number of pulses and the time $t_S$ required for said second pulse generating means to generate a predetermined number of pulses and for calculating and displaying the time difference $\Delta t = t_B - t_S$ as a measure of yarn storage on said reserve disc.

2. In a textile yarn processing machine, as set forth in claim 1, in which said first and second electrical pulse generating means comprise photoelectric cell means.

3. In a textile yarn processing machine, as set forth in claim 1, in which said first electrical pulse generating means comprises photoelectric cell means and said second electrical pulse generating means comprises a yarn feeler switch mechanism for being contacted during each rotation of the balloon of yarn.

4. In a textile yarn processing machine, as set forth in claim 1, in which one of said first and second electrical pulse generating means is permanently secured to said spindle assembly and the other of said first and second electrical pulse generating means is not secured to said spindle assembly and may be portably brought to said spindle assembly for performing a yarn storage measurement.

5. In a textile yarn processing machine, as set forth in claim 1, in which said means connected with said pulse generating means includes means for multiplying the calculated time difference $\Delta t$ by the frequency of rotation of said rotor mechanism which is equal to the number of pulses generated by said first electrical pulse generating means in one second and for displaying the result as a measure of yarn storage on said reserve disc in fractions of a complete revolution of yarn around said reserve disc.

6. In a textile yarn processing machine, as set forth in claim 1, in which said means connected with said pulse generating means includes means for dividing the calculated time difference $\Delta t$ by the time period between two pulses generated by said first electrical pulse generating means and for displaying the result as a measure of yarn storage on said reserve disc in fractions of a complete revolution of yarn around said reserve disc.

7. A method for measuring yarn storage at a spindle assembly station in a textile yarn processing machine, such as a two-for-one twister or the like, in which each station includes a spindle assembly for carrying a package of yarn to be withdrawn and processed while producing a rotating balloon of the yarn around the package and having a hollow carrier mechanism for supporting the package of yarn to be processed and providing a passageway for receiving the yarn as it is withdrawn from the package, and a driven rotor mechanism supporting the carrier mechanism and rotating relative thereto and including a yarn reserve disc providing a passageway for the yarn therethrough from the carrier mechanism and for storing a length of the yarn therearound prior to the formation of the balloon of yarn; said method comprising the steps of:

counting a predetermined number of revolutions of the rotor mechanism of the spindle assembly;

counting a predetermined number of revolutions of the rotating balloon of yarn; and evaluating the time $t_B$ required for the predetermined number of revolutions of the rotor mechanism and the time $t_S$ required for the predetermined number of revolutions of the balloon of yarn and calculating the time difference $\Delta t = t_B - t_S$ as a measure of yarn storage on the reserve disc.

8. A method for measuring yarn storage, as set forth in claim 7, further including multiplying the calculated time difference $\Delta t$ by the frequency of rotation of the rotor mechanism which is equal to the number of revolutions of said rotor mechanism in 1 second as a measure of yarn storage on said reserve disc in fractions of a complete revolution of yarn around the reserve disc.

9. A method for measuring yarn storage, as set forth in claim 7, further including dividing the calculated time difference $\Delta t$ by the time between two revolutions of the rotor mechanism as a measure of yarn storage on the reserve disc in fractions of a complete revolution of yarn around the reserve disc.

10. A method for measuring yarn storage at a spindle assembly station in a textile yarn processing machine, such as a two-for-one twister or the like, in which each station includes a spindle assembly for carrying a package of yarn to be withdrawn and processed while producing a rotating balloon of the yarn around the package and having a hollow carrier mechanism for supporting the package of yarn to be processed and providing a passageway for receiving the yarn as it is withdrawn from the package, and a driven rotor mechanism supporting the carrier mechanism and rotating relative thereto and including a yarn reserve disc providing a passageway for the yarn therethrough from the carrier mechanism and for storing a length of the yarn therearound prior to formation of the balloon of yarn; said method comprising the steps of:

generating electrical pulses in response to the frequency of rotation of the rotor mechanism of the spindle assembly;

generating electrical pulses in response to the frequency of rotation of the balloon of yarn;

counting a predetermined number of pulses generated by rotation of the rotor mechanism and counting a predetermined number of pulses generated by rotation of the balloon of yarn;

evaluating the time $t_B$ required for generation of the predetermined number of pulses by rotation of the rotor mechanism and the time $t_S$ required for generation of the predetermined number of pulses by rotation of the balloon of yarn and calculating the time difference $\Delta t$ equals $t_B - t_S$ as a measure of yarn storage on the reserve disc.

* * * * *